United States Patent [19]

Hough et al.

[11] Patent Number: 4,920,583

[45] Date of Patent: May 1, 1990

[54] VIBRATING TOILET SEAT

[76] Inventors: Thomas W. Hough, 4013 Lawndale St., Philadelphia, Pa. 19124; Warren D. Brown, 7412 Pennway St., Apt. #1, Philadelphia, Pa. 19111

[21] Appl. No.: 743,038

[22] Filed: Jun. 10, 1985

[51] Int. Cl.[5] ..... A47K 13/00; A61H 1/00

[52] U.S. Cl. ..... 4/237; 4/234; 4/661; 128/33

[58] Field of Search ..... 4/237, 242, 234, 213, 4/661; 128/33, 32

[56] References Cited

U.S. PATENT DOCUMENTS

| | | | |
|---|---|---|---|
| 2,891,538 | 6/1959 | Moxley | 128/33 |
| 2,894,505 | 7/1959 | Manausa | 128/33 |
| 2,943,621 | 7/1960 | Phillips et al. | 128/33 |
| 3,037,499 | 6/1962 | Cummins | 128/33 |
| 3,244,168 | 4/1966 | Bayard | 128/33 |
| 3,322,117 | 5/1967 | McCaw | 128/33 |
| 3,455,296 | 7/1969 | McCaleb | 128/33 |
| 4,064,376 | 12/1977 | Yamada | 128/33 X |
| 4,159,714 | 7/1979 | Peterson | 128/33 |

*Primary Examiner*—Henry K. Artis

*Attorney, Agent, or Firm*—Seidel, Gonda, Lavorgna & Monaco

[57] ABSTRACT

A vibrating toilet seat is provided, wherein a vibrating motor is placed within a cushioned toilet seat. The motor is automatically actuated when the user sits on the seat. The motor can also be turned on manually. Power for the vibrating unit can be derived from a battery pack, or the unit can be plugged into a standard wall outlet. The invention can be used in conjunction with existing cushioned toilet seats, which can be easily modified to accommodate the vibrator motor and switching mechanism. The invention is not limited to use with toilet seats, but can also be used with automobile seats, or with other types of seats.

10 Claims, 2 Drawing Sheets

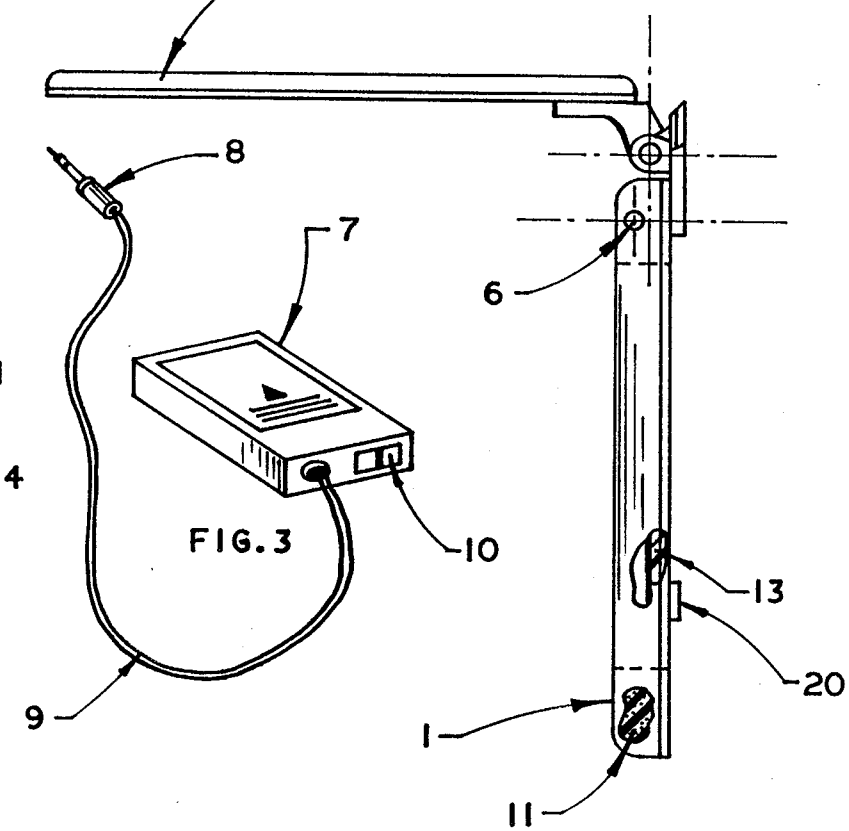
FIG. 3
FIG. 2
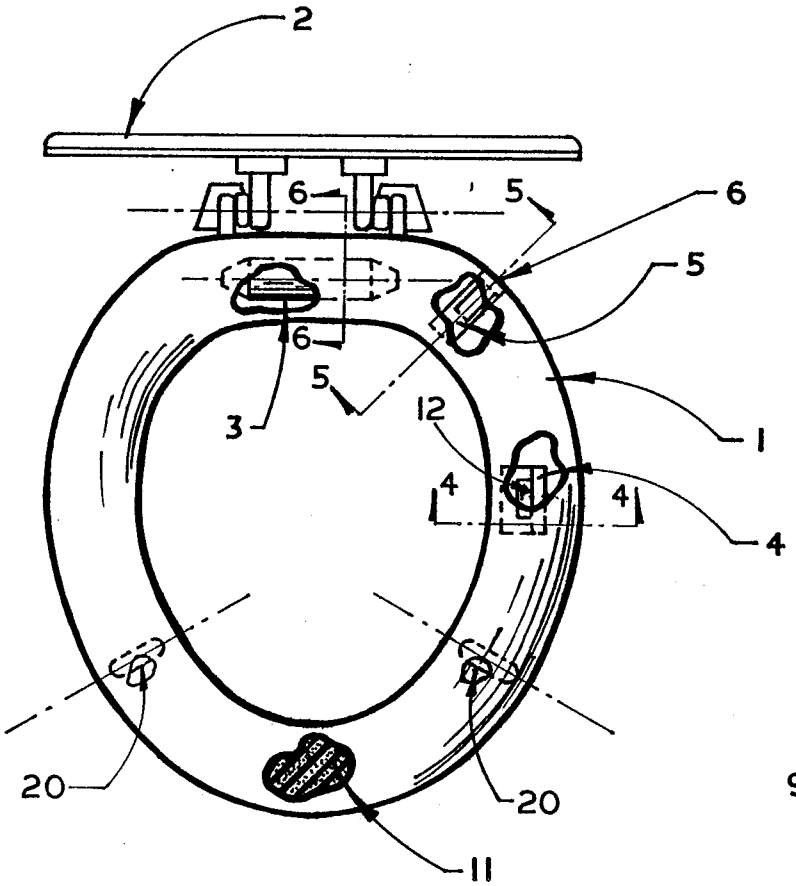
FIG. 1

VIBRATING TOILET SEAT

BACKGROUND OF THE INVENTION

This invention relates to toilet seats, and in particular, to toilet seats of the cushioned type. However, the concept of the invention can be applied to many different kinds of seats, and not just to toilet seats.

The decoration and comfort of bathrooms has been given increased attention in recent years. In accordance with this trend, cushioned toilet seats have become very popular. One example of a cushioned toilet seat is shown in U.S. Pat. No. 4,451,940. The present invention adds a dimension of comfort and stimulation to a cushioned toilet seat, in a manner not previously known. The concept of the invention can also be used in automobiles, to increase the comfort of the driver and passengers. The concept can, in fact, be applied, to a wide variety of seats.

SUMMARY OF THE INVENTION

The present invention comprises a vibrating motor mounted within a cushioned toilet seat. A switch is mounted within the seat, so that the vibrator is turned on automatically when the user sits on the seat. The vibrator and switch are mounted in hollowed-out portions of a conventional cushioned toilet seat. The means for affixing the seat to the toilet bowl is not affected by the invention. In fact, the exterior of the toilet seat does not reveal that a vibrator is inside. The outward appearance of the invention is identical to that of a conventional cushioned toilet seat, and can be cleaned in the same way.

In the preferred embodiment, the vibrator receives its power from a portable battery unit, thereby eliminating the danger of electric shock to the user. But the vibrator can also derive power from conventional house current, suitably transformed, if desired.

The vibrator can also be mounted within the toilet seat cover, instead of in the seat itself. The battery pack can also be mounted within the seat cover, thus eliminating the need for an external power source.

The invention can also be applied to seats other than toilet seats. One such other use is in an automobile seat, or in an auxiliary seat cushion for use in an automobile.

It is therefore an object of the invention to provide a vibrating seat apparatus.

It is another object to provide a toilet seat which begins to vibrate automatically when the user sits on the seat.

It is another object to provide a toilet seat as described above, wherein the seat employs a conventional cushioned toilet seat, and wherein the outward appearance of the seat is identical to that of a conventional cushioned toilet seat.

It is another object to provide a toilet seat as described above, wherein the seat can be readily cleaned and disinfected.

It is another object to provide a toilet seat as described above, wherein the seat may be operated with either batteries or with house current.

It is another object to provide a toilet seat as described above, wherein the seat can be readily affixed to almost any conventional toilet bowl.

It is another object to provide a toilet seat as described above, wherein the seat can also be used as a non-vibrating, conventional cushioned toilet seat.

It is another object to provide a vibrating seat, which can be used in many environments as a principal or auxiliary seat, such as in an automobile, a meeting room, or in other places.

Other objects and advantages of the invention will be apparent to those skilled in the art, from a reading of the following brief description of the drawings, the detailed description of the invention, and the appended claims.

BRIEF DESCRIPTION OF THE DRAWINGS

FIG. 1 is a top view, partly broken away, of the toilet seat of the present invention.

FIG. 2 is a side view of the toilet seat shown in FIG. 1, also partly broken away, and showing a female coupling for supplying current to the vibrator.

FIG. 3 is a perspective view of the battery assembly used to power the invention.

DETAILED DESCRIPTION OF THE INVENTION

Figure 6:
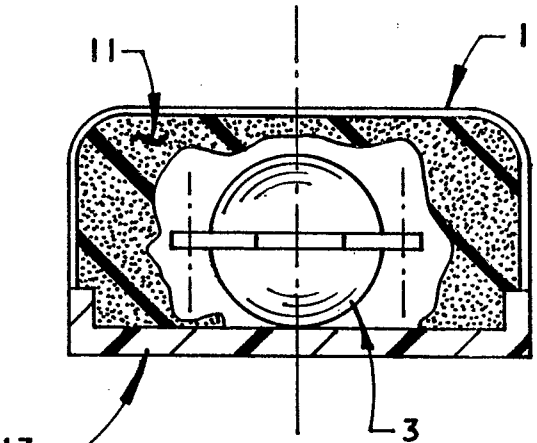
FIG. 6 is a cross-sectional view, taken along the line 6—6 of FIG. 1.

The present invention is illustrated in the top view of FIG. 1. Seat 1 and seat cover 2 are shown, with a vibrating motor 3 embedded in the seat. The seat is of the cushioned type, and is provided with conventional padding material 11, which could be foam, or another cushioning material. The motor is shown at the rear of the seat, but it is understood that the motor can be placed at other locations within the seat. Micro-switch assembly 4, having micro-switch 12, is also embedded in seat 1. Also shown is female power source connector 6, the power source connector being attached to the seat by mounting bracket 5. Micro-switch 12 actuates the vibrating motor 3, as will be described below. The seat is supported on the toilet bowl by rests 20.

FIG. 3 illustrates the preferred power source for use with the invention. The figure shows power pack 7, main switch 10, power cord 9, and male jack 8. Within power pack 7 is a 3-volt battery, although other voltages could be employed. When male jack 8 is inserted into female connector 6, the 3-volt power source is available to operate the motor 3, provided the micro-switch 12 is actuated. If the micro-switch is actuated, the power source can be deactivated by turning off the main power switch 10. Thus, the seat 1 can be used as a conventional, non-vibrating cushioned toilet seat. Also, the user can turn off the vibrator motor, while sitting on the seat, if vibration is no longer desired.

Figure 7:
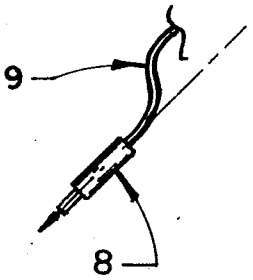
FIG. 7 is a top view of the vibrating motor, and of the wiring used to power the motor.
Figure 7:
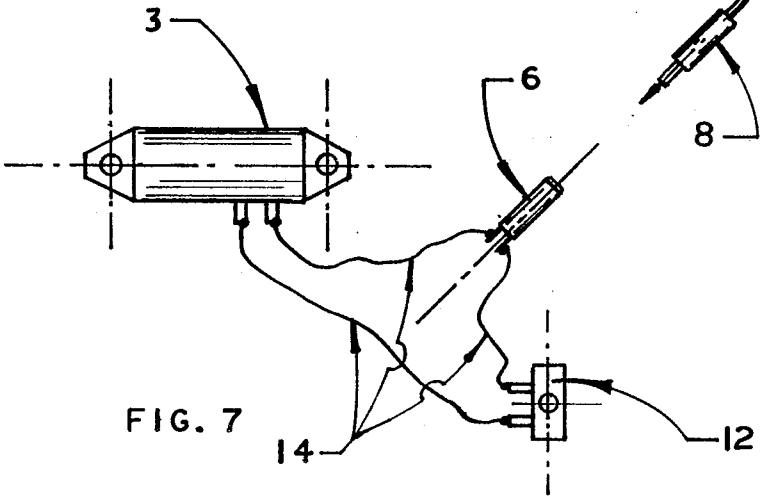

FIG. 7 shows the electrical wiring needed to actuate the vibrating motor 3. FIG. 7 shows three wires 14, which are housed in seat 1. The figure clearly shows the electrical connection to be made by inserting male jack 8 into female coupling 6. Micro-switch 12 is also shown, and it is clear from the figure that micro-switch 12 must be closed before the vibrator 3 will operate.

Figure 4:
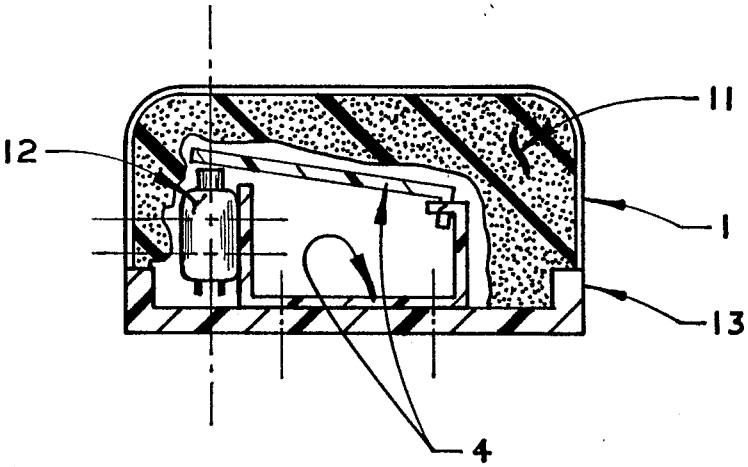
FIG. 4 is a cross-sectional view, taken along the line 4—4 of FIG. 1.
Figure 5:
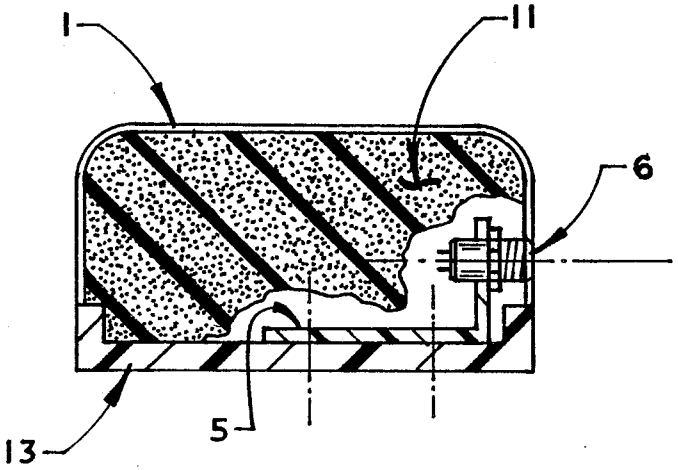
FIG. 5 is a cross-sectional view, taken along the line 5—5 of FIG. 1.

Micro-switch 12 is secured in place within micro-switch housing 4, illustrated more clearly in the cross-sectional view of FIG. 4. Micro-switch housing 4 comprises two pieces, one of which is secured to the seat frame 13, and the other of which pivots around the first piece. When pressure is applied to seat 1, such as when the user sits on the seat, the padding 11 is compressed, and the pivoting piece of the micro-switch housing 4 is pressed down, thereby actuating micro-switch 12. When the main switch 10 is in the "on" position, micro-switch 12 completes the circuit from the power source to the vibrating motor 3. The power source can also be deactivated by removing the male jack 8 from female connector 6.

FIG. 6 shows the vibrating motor 3, which is secured tightly to the frame 13 of toilet seat 1. Because the motor is so tightly secured to the frame, vibrations from the motor are spread equally throughout the complete cushioned toilet seat, providing an even, pulsating feeling around the entire perimeter of the seat.

In operation, the user merely sits on the toilet seat, and, if the main switch 10 is "on", vibration begins immediately. Vibration will continue until the user either rises from the seat, or turns the main switch 10 "off", or removes the jack 8 from female connector 6.

The present invention, when incorporated into a conventional cushioned toilet seat, can be easily installed on virtually any toilet bowl. The addition of the vibrating motor, the micro-switch, and the power connection, will not affect the means of affixation to the toilet bowl. Indeed, the outward appearance of the invention is identical to that of a conventional cushioned toilet seat. All of the devices of the invention are concealed within the seat.

The present invention can therefore be easily cleaned or disinfected, in the same manner as is done for a conventional toilet seat. The invention is very safe, especially when used with the low voltage power source. And the invention is very easy to use; vibration is normally controlled merely by sitting on the seat, and by rising from the seat.

Use of the invention induces relaxation, stimulation, comfort, and general pleasure associated with vibrations. The invention can also be helpful in assisting natural body functions. The invention has the same size and appearance as a conventional cushioned toilet seat, and can be used in the conventional way if the power switch is simply turned off.

As stated above, the invention is not limited to the area of toilet seats. The concept can be applied in many other contexts. For example, an automobile seat, or an auxiliary cushion for use in an automobile, can be fitted with a vibrating motor and switch, as described above. An auxiliary or principal seat, for use in a meeting room, can be similarly fitted. As long as the seat is constructed to include a hollow portion, for the vibrator, and is sufficiently flexible to allow actuation of the micro-switch, virtually any cushioned seat used in almost any context can be used to practice the present invention.

Various changes may be made in the invention as described above. The exact locations of the vibrating motor, the micro-switch, and the power connector may be modified. The source of power may be standard ac house current, which would be transformed (and rectified, in the case of a dc motor) for use by the vibrating motor. The type of padding material in the seat is, of course, not critical. Furthermore, a vibrating motor could be placed in the cover of the seat, either instead of, or in addition to, the motor in the seat itself. The latter change would produce vibrations at the user's back, which would add a totally new sensation.

The battery pack could also be placed in the seat cover, (or the seat back, if the invention is not used with a toilet seat), as long as the cover is sufficiently thick. In fact, either the vibrating motor or the battery pack could be located in either the seat or the cover. Placing the battery pack within the seat or the cover has the advantage of concealing the power source from the user, and improves the overall appearance of the product.

It is understood that the modifications described above, and other similar variations of the invention, are to be deemed within the spirit and scope of the following claims.

What is claimed is:

1. A self-contained vibrating auxiliary seat apparatus comprising: (a) a base portion adapted to be movably supported on a support surface and to support a person in a seated position thereon, at least a portion of the base portion being hollow; (b) vibrating means mounted within the hollow of the base portion and completely concealed within the base portion; and (c) actuation means for controlling the operation of the vibrating means, the actuation means mounted within the hollow of the base portion and concealed within the base portion, the actuation means including a first switch means mounted within the base portion, the switch means positioned for actuation from the pressure from a person sitting on the base portion; wherein the base portion substantially has an outward appearance of an ordinary seat.

2. The apparatus of claim 1, further comprising power supply means, the power supply means having a second switch means, the second switch means being capable of cutting off power to the vibrating means.

3. The apparatus of claim 2 wherein the base portion further comprises a connector for attachment to a power supply means, the connector being in electrical contact with the vibrating means and the first switch.

4. The apparatus of claim 3, wherein the vibrating means comprises a motor, the motor being securely mounted within the base portion.

5. The apparatus of claim 4, wherein the first switch means comprises a fixed piece, mounted on the base portion, and a pivoting piece, mounted to move over a switch, the pivoting piece movable onto the switch for actuation thereof in response to pressure applied to the base portion.

6. The apparatus of claim 5, a wherein the base portion includes an opening in the center thereof and is adapted to function as a toilet seat.

7. The apparatus of claim 6, wherein the vibrating motor and the switch means are mounted at different locations within the base portion.

8. A self-contained vibrating seat apparatus, comprising: a cushioned seat, the seat having a hollow portion therein, a vibrating motor disposed in the hollow portion, and a switch means disposed within the hollow portion, the switch means being connected to selectively actuate the vibrating motor in response to pressure exerted on the seat wherein the vibrating motor and the switch means are completely concealed within the seat, and wherein the seat has the outward appearance of an ordinary cushioned seat, and wherein the seat can be used both as a vibrating seat and as a non-vibrating seat.

9. The apparatus of claim 8, further comprising power supply means, connectable to the switch means, wherein the power supply means can deliver power to the vibrating motor.

10. A self-contained vibrating auxiliary seat apparatus comprising: a base portion adapted to be movably supported on a support surface and to support a person in a seated position thereon, the base portion including an opening in the center thereof and adapted to function as a toilet seat, at least a portion of the base portion being hollow; vibrating means mounted within the hollow of the base portion and completely concealed therein; and actuation means for controlling the operation of the vibrating means, the actuation means mounted within the hollow of the base portion and being completely concealed therein; wherein the base portion has an outward appearance of an ordinary toilet seat and wherein the seat can be selectively used as both a vibrating seat and a non-vibrating seat.

* * * * *